US008813968B1

(12) United States Patent
Mandeville et al.

(10) Patent No.: US 8,813,968 B1
(45) Date of Patent: Aug. 26, 2014

(54) WOOD PELLET SCREEN APPARATUS

(71) Applicants: Daniel Mandeville, Slatersville, RI (US); Rhonda Mandeville, Slatersville, RI (US)

(72) Inventors: Daniel Mandeville, Slatersville, RI (US); Rhonda Mandeville, Slatersville, RI (US)

( * ) Notice: Subject to any disclaimer, the term of this patent is extended or adjusted under 35 U.S.C. 154(b) by 9 days.

(21) Appl. No.: 13/652,698

(22) Filed: Oct. 16, 2012

Related U.S. Application Data

(60) Provisional application No. 61/590,915, filed on Jan. 26, 2012.

(51) Int. Cl.
*B07B 1/06* (2006.01)

(52) U.S. Cl.
USPC ..... 209/281; 209/403; 209/420

(58) Field of Classification Search
USPC ..... 209/235, 259, 281, 352–356, 370, 403, 209/420
See application file for complete search history.

(56) References Cited

U.S. PATENT DOCUMENTS

| | | | | | |
|---|---|---|---|---|---|
| 311,485 | A * | 2/1885 | Johnson | 209/412 |
| 1,424,451 | A * | 8/1922 | Crandall | 209/413 |
| 1,510,742 | A * | 10/1924 | Gutleben | 209/420 |
| 3,307,698 | A * | 3/1967 | Haffner | 209/258 |
| 4,990,249 | A * | 2/1991 | Leuenberger | 210/167.31 |
| 5,330,643 | A * | 7/1994 | Webb et al. | 210/255 |
| 5,413,709 | A * | 5/1995 | Webb et al. | 210/255 |
| 5,624,038 | A * | 4/1997 | Curtis | 209/281 |
| 5,641,071 | A * | 6/1997 | Read et al. | 209/319 |
| 7,591,377 | B2 * | 9/2009 | Puda et al. | 209/358 |
| 2005/0006284 | A1 * | 1/2005 | Zeller | 209/404 |
| 2008/0223763 | A1 * | 9/2008 | Dees | 209/352 |

* cited by examiner

*Primary Examiner* — Joseph C Rodriguez
*Assistant Examiner* — Kalyanavenkateshware Kumar
(74) *Attorney, Agent, or Firm* — Salter & Michaelson

(57) ABSTRACT

A wood pellet screen apparatus that is formed of a housing having a pair of legs. The housing includes a series of interconnected walls that form a collection chamber. An elongated screen is disposed in the housing over the collection chamber. The screen is constructed and arranged to receive wood pellets deposited thereon. The screen is further constructed and arranged to be tilted at an angle to the horizontal so that as wood pellets are deposited at a top of the screen the wood pellets progress along the screen under gravity control.

4 Claims, 10 Drawing Sheets

WOOD PELLET SCREEN APPARATUS

RELATED CASES

Priority for this application is hereby claimed under 35 U.S.C. §119(e) to U.S. Provisional Patent Application No. 61/590,915 which was filed on Jan. 26, 2012 and which is incorporated by reference herein in its entirety.

FIELD OF THE INVENTION

The present invention relates to a wood pellet screen. This is used for screening wood pellets so as to remove excess debris, particles or shavings associated with the individual pellets so that the wood pellets that are fed into a stove are free of excess debris and possible contamination products.

BACKGROUND OF THE INVENTION

Pellets are usually provided in a bag form and are sold commercially in that form. The content of the bag is typically placed in a pellet stove hopper without screening. However, it has been found that there is sufficient debris associated with the pellets usually in the form of a dust from the pellets that can cause difficulties in operating the pellet stove. Also this removes the dust from entering your home or business. The present invention has come to the realization that improved pellet stove operation can be attained by pre-screening the wood pellets as taken from their storage bag.

Accordingly, it is an object of the present invention to provide a step of screening the pellets as they are dumped from the storage bag for the pellets.

SUMMARY OF THE INVENTION

The wood pellet screen of the present invention thus provides a far cleaner pellet that, once used, will not cause difficulties with regard to the operation of the pellet stove. By cleaning the pellets through this screening process, any dust, debris and particles are removed and thus are not deposited in the pellet stove and throughout your home or business. In that way, the pellet stove can operate more efficiently and does not have a problem with clogging as is typical when the pellets are not so screened. Also, the use of the screen of the present invention greatly limits the amount of dust that would fly around the house when the wood pellets are not so screened.

In accordance with the present invention there is provided a wood pellet screen apparatus comprising: a housing having a pair of legs for the support thereof; the housing comprised of a series of interconnected walls that form a collection chamber; an elongated screen disposed in the housing over the collection chamber; the screen constructed and arranged to receive wood pellets deposited thereon; and the screen further constructed and arranged to be tilted at an angle to the horizontal so that as wood pellets are deposited at the top of the screen the wood pellets progress along the screen under gravity control.

In accordance with other aspects of the present invention the screen has a length greater than its width; the elongated screen has an arcuate curvature; the screen has a series of adjacent apertures over which the wood pellets progress; the apertures are diamond shaped and each has at least one sharp edge; each aperture has multiple upwardly facing sharp edges; the housing is defined by a bottom wall, a pair of like side walls and a rear wall that together define the internal chamber; a clean out port in the rear wall through which collected dust and debris may be removed from the chamber; the screen tilt angle is in a range of 30-45 degrees; the screen tilt angle is on the order of 35 degrees.

In accordance with another version of the present invention there is provided a wood pellet screen apparatus comprising: a housing having a bottom wall, a pair of side walls extending from the bottom wall and a rear wall; the housing walls constructed and arranged to form a collection chamber; an elongated screen disposed in the housing over the collection chamber; the screen constructed and arranged to receive wood pellets deposited thereon; and the screen further constructed and arranged to be tilted at an angle to the horizontal so that as wood pellets are deposited at a top end of the screen the wood pellets progress along the screen under gravity control, and are then deposited in a receiving bucket at a bottom end of the screen.

In accordance with other aspects of the present invention the screen has a length greater than its width; the elongated screen has an arcuate curvature, and the screen has a series of adjacent apertures over which the wood pellets progress; the apertures are diamond shaped and each has at least one sharp edge; each aperture has multiple upwardly facing sharp edges; including legs for supporting the housing above a ground level; including two pairs of legs spaced apart on the housing and each formed from a single U-shaped leg piece, the legs being supported for pivoting between a use position and a storage position, the legs being supported by a support rod and securing nuts for loosening or tightening the positions; including a clean out port in the rear wall through which collected dust and debris may be removed from the chamber; the screen tilt angle is in a range of 30-45 degrees; and the screen tilt angle is on the order of 35 degrees.

DESCRIPTION OF THE DRAWINGS

It should be understood that the drawings are provided for the purpose of illustration only and are not intended to define the limits of the disclosure. In the drawings depicting the present invention, all dimensions are to scale. The foregoing and other objects and advantages of the embodiments described herein will become apparent with reference to the following detailed description when taken in conjunction with the accompanying drawings in which.

DETAILED DESCRIPTION

Figure 2:
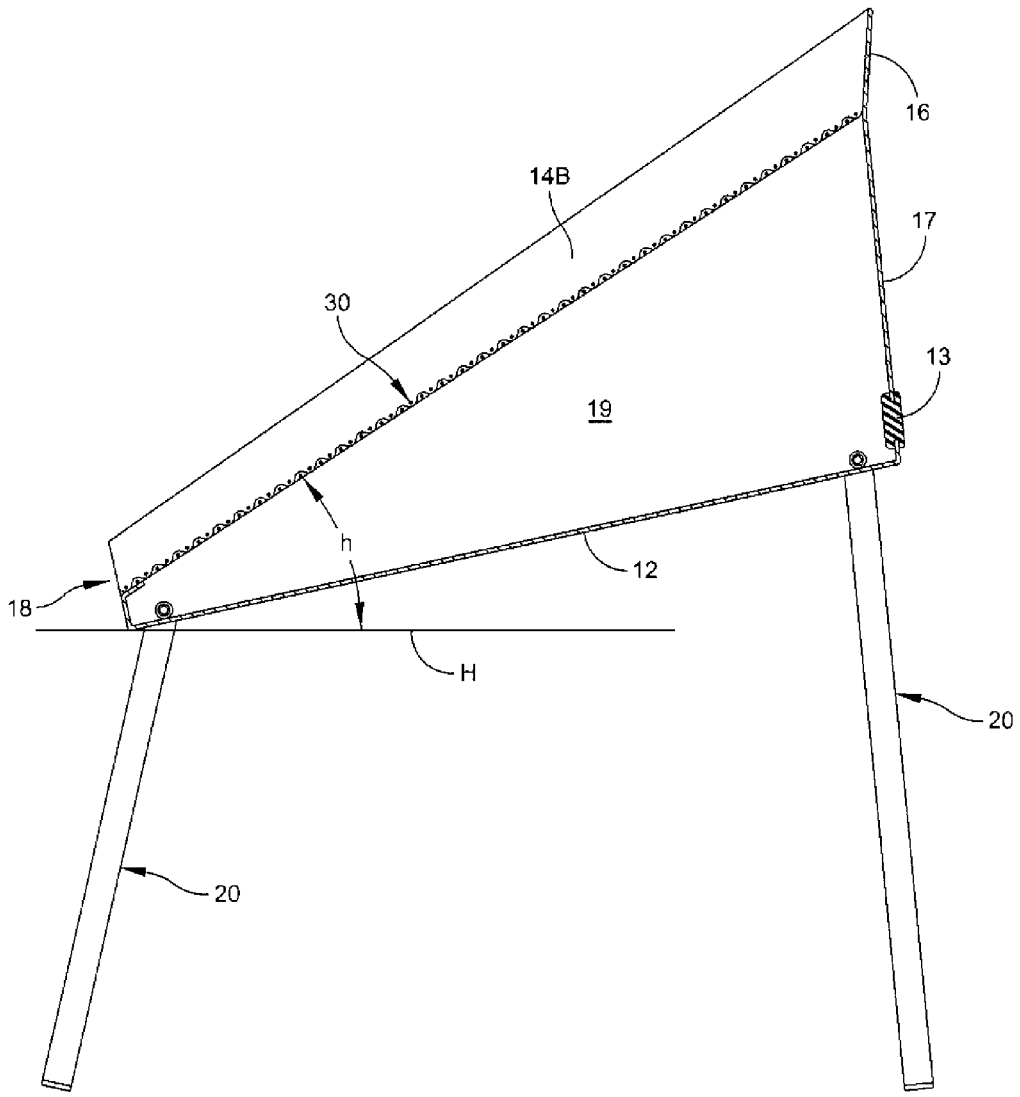
FIG. 2 is a side elevation view of the screen of FIG. 1.
Figure 8:
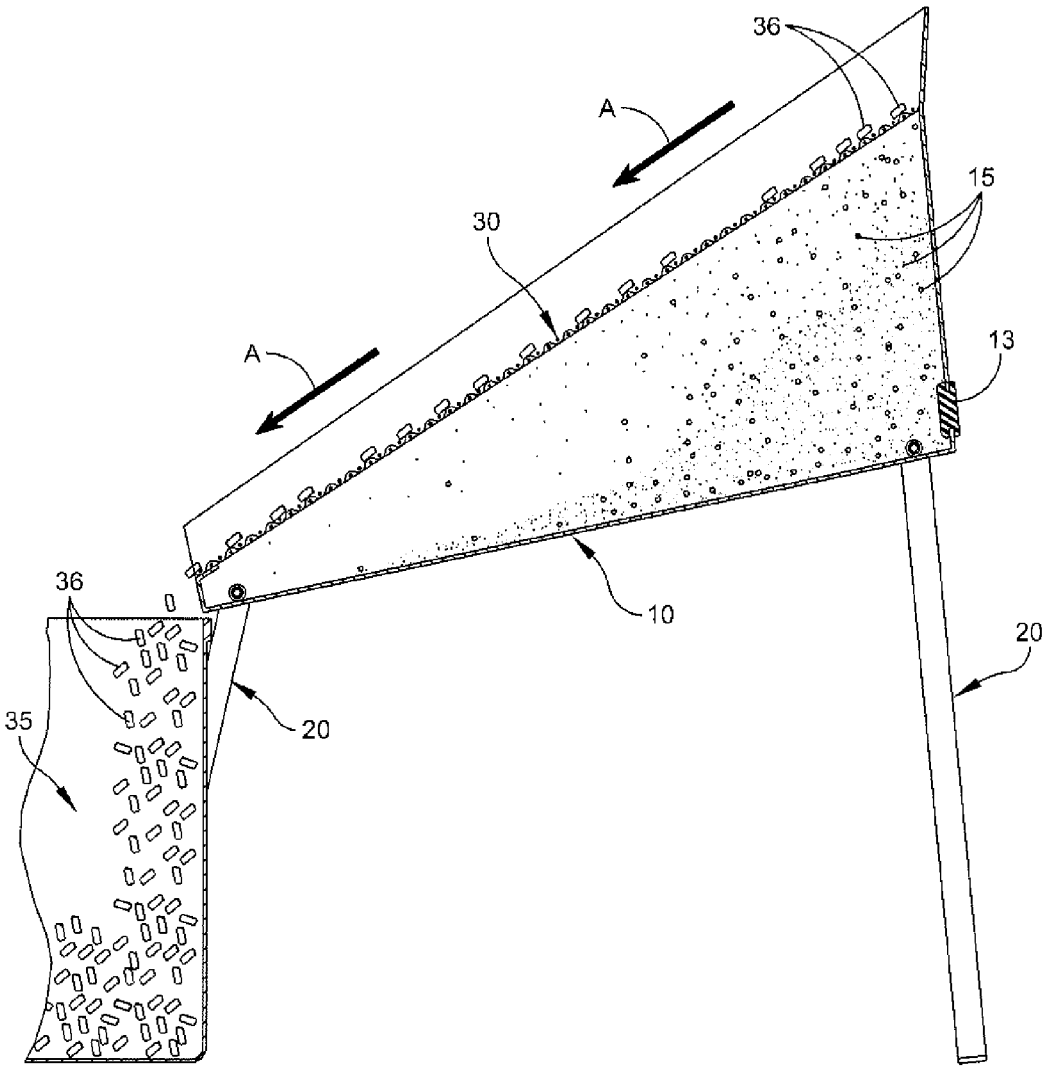
FIG. 8 is a side elevation view illustrating the pellets as they progress down the screen and the associated debris and dust that is accumulated within the screen chamber.
Figure 10:
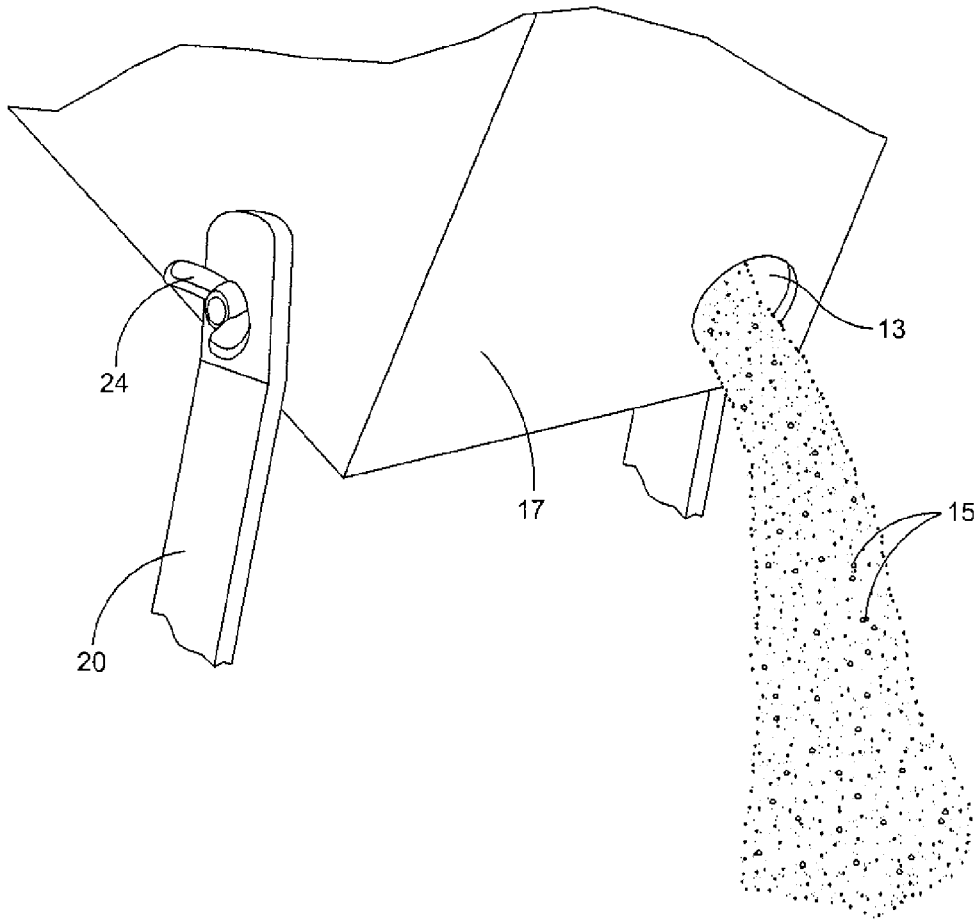
FIG. 10 is a fragmentary perspective view showing the manner in which the dust and debris may be dumped from the pellet screen chamber.

Reference is now made to the drawings for one embodiment of the present invention. This wood pellet screen 10 includes a bottom 12, spaced side walls 14, a top wall 16, back wall 17 as illustrated in FIG. 2, and an open bottom end at 18. The side walls 14 may be considered as including a bottom section 14A and a top section 14B. These various side walls define an open collection chamber 19 such as illustrated in FIGS. 2 and 8. The various walls comprising the apparatus may be connected together in any one of a number of ways such as by riveting. Also, at least some of the walls can be constructed by bending into other walls. For example walls 14A and 14B can be constructed of a single piece bent into form. It is within this chamber 19 that the dust particles 15 are collected. See FIG. 8. As also depicted in FIG. 2, the back wall 17 has a closure port 13 that is shown closed in FIG. 2 but is shown open in FIG. 10 so that the debris and dust particles can be removed from the chamber 19.

Figure 3:
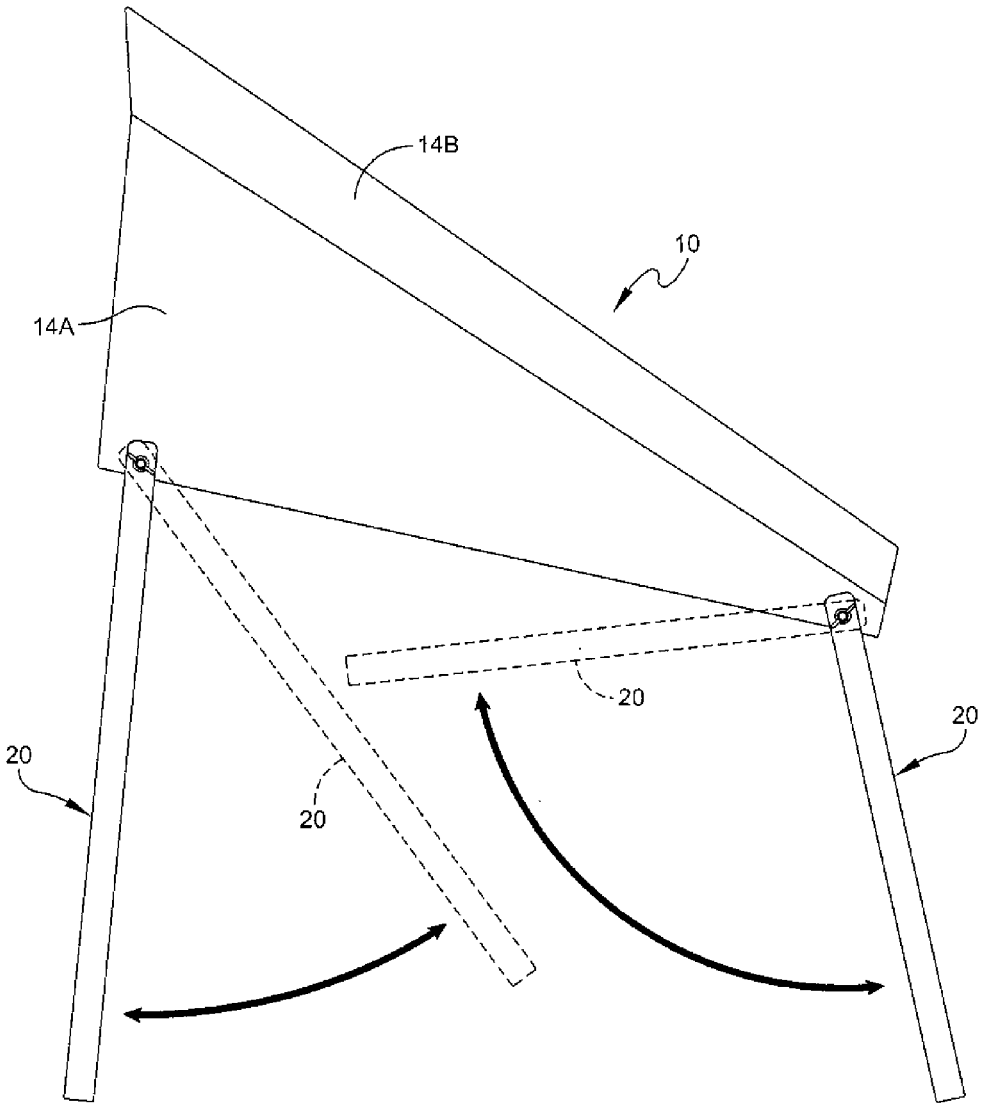
FIG. 3 is a schematic opposite side elevation view showing the manner in which the legs of the pellet screen can be folded.

The screen 10 is supported by a pair of U-shaped legs 20. For further details of the leg support refer to the fragmentary perspective view of FIG. 4 and the cross-sectional view of FIG. 5. For this purpose there maybe provided an elongated rod 22 threaded at each end and passing through the screen. The ends of the rod are secured by means of acorn and butterfly nuts 24. Reference is also made to FIG. 3 which shows the manner in which the legs 20 can be folded from a use position shown in solid outline to a folded position shown in dotted outline. This is convenient for when the screen is not being used and can be stored away.

Figure 4:
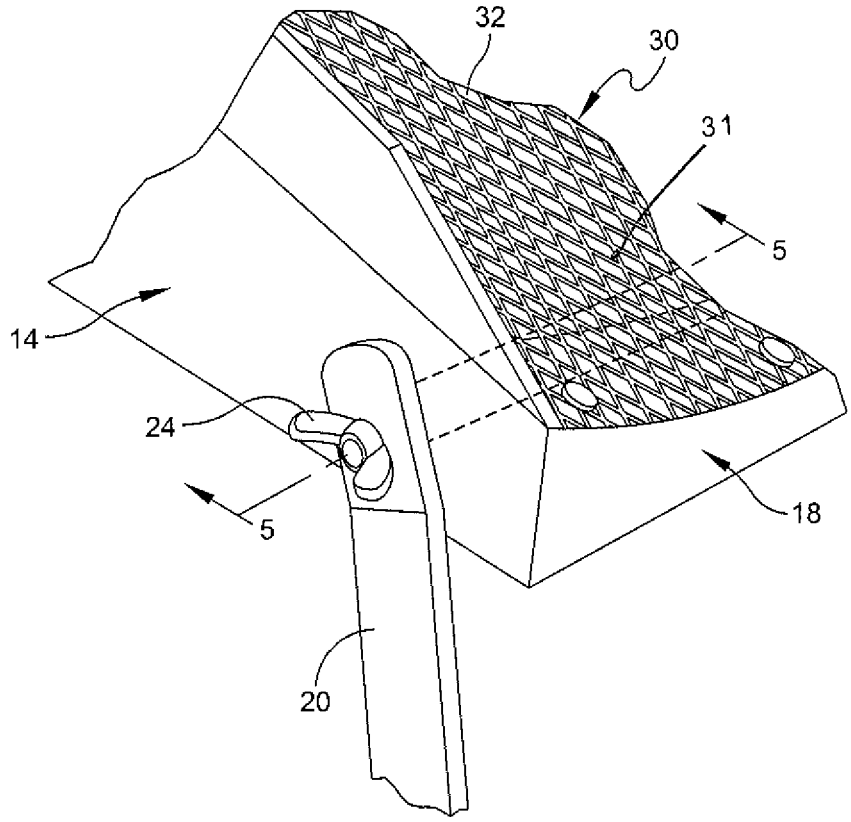
FIG. 4 is a fragmentary perspective view showing the area where the legs attach to the screen.
Figure 7:
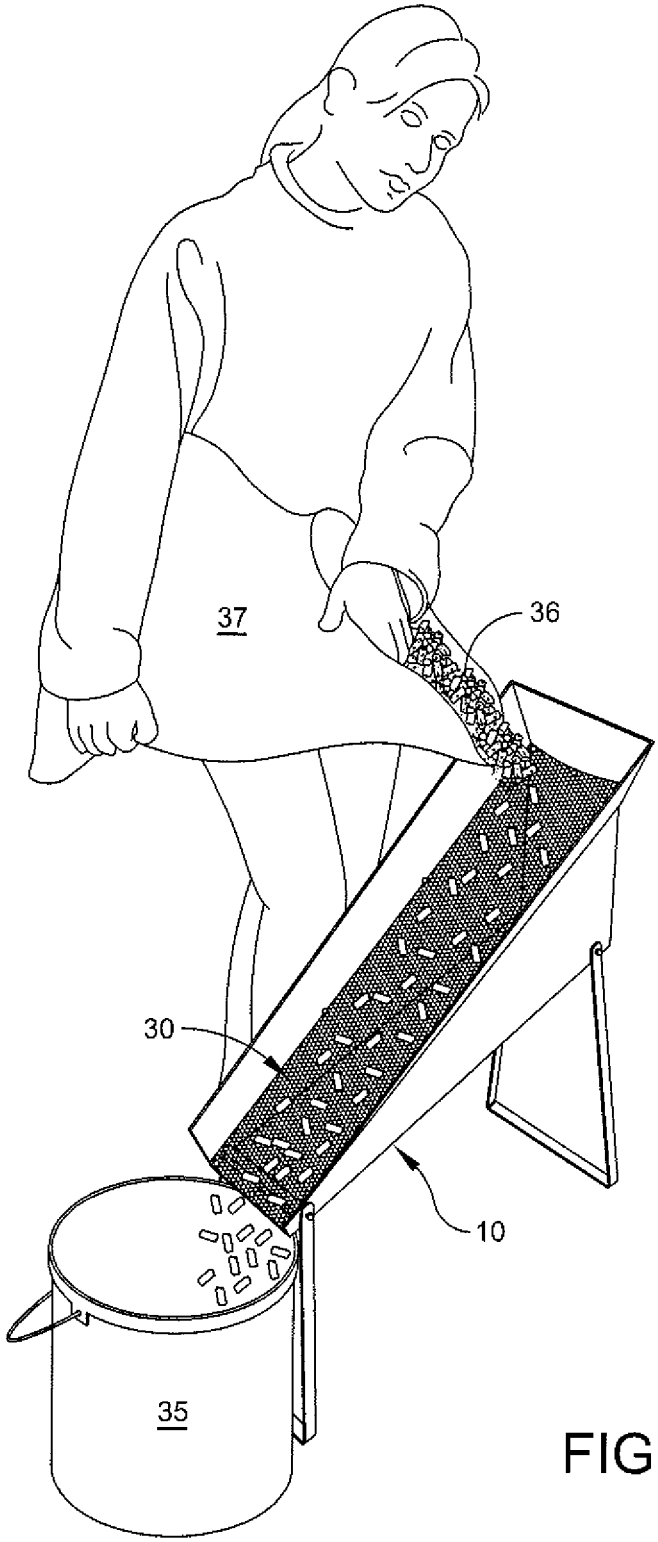
FIG. 7 is a schematic diagram illustrating the manner in which the pellets are deposited at the top of the screen.

The main screening of the pellets is performed by the screen 30 which extends the length of the side walls 14. Refer also to FIG. 4 which shows somewhat more detail of the screen 30 which includes a series of small diamond shape apertures 32. Each of these apertures may have a somewhat sharp edge 31. In that way, as the pellets are dropped onto the screen, such as in the view of FIG. 7, the pellets progress along preferably the full length of the screen and rotate past each of these apertures as they progress to the bottom of the screen and are collected in the pail 35. Preferably each of the upwardly facing edges defining the diamond shaped apertures is sharp so that as each wood pellet progresses down the screen the optimum screening process occurs by virtue of the individual wood pellets contacting these sharp edges to remove any excess particles or dust from the wood pellet. FIG. 7 shows a user of the screen dumping the pellets 36 from the bag 37. By the time that the pellets progress along the entire length of the screen 30, any debris, dust or other particles that may have accumulated on the pellets or within the bag 37 are removed by the continuous movement over several apertures and then deposited within the chamber 19 as illustrated in FIG. 8. FIG. 8 also shows the directional arrow A the direction that the pellets progress along the surface of the screen 30. The wood pellets effectively progress along the screen under gravity control.

Figure 1:
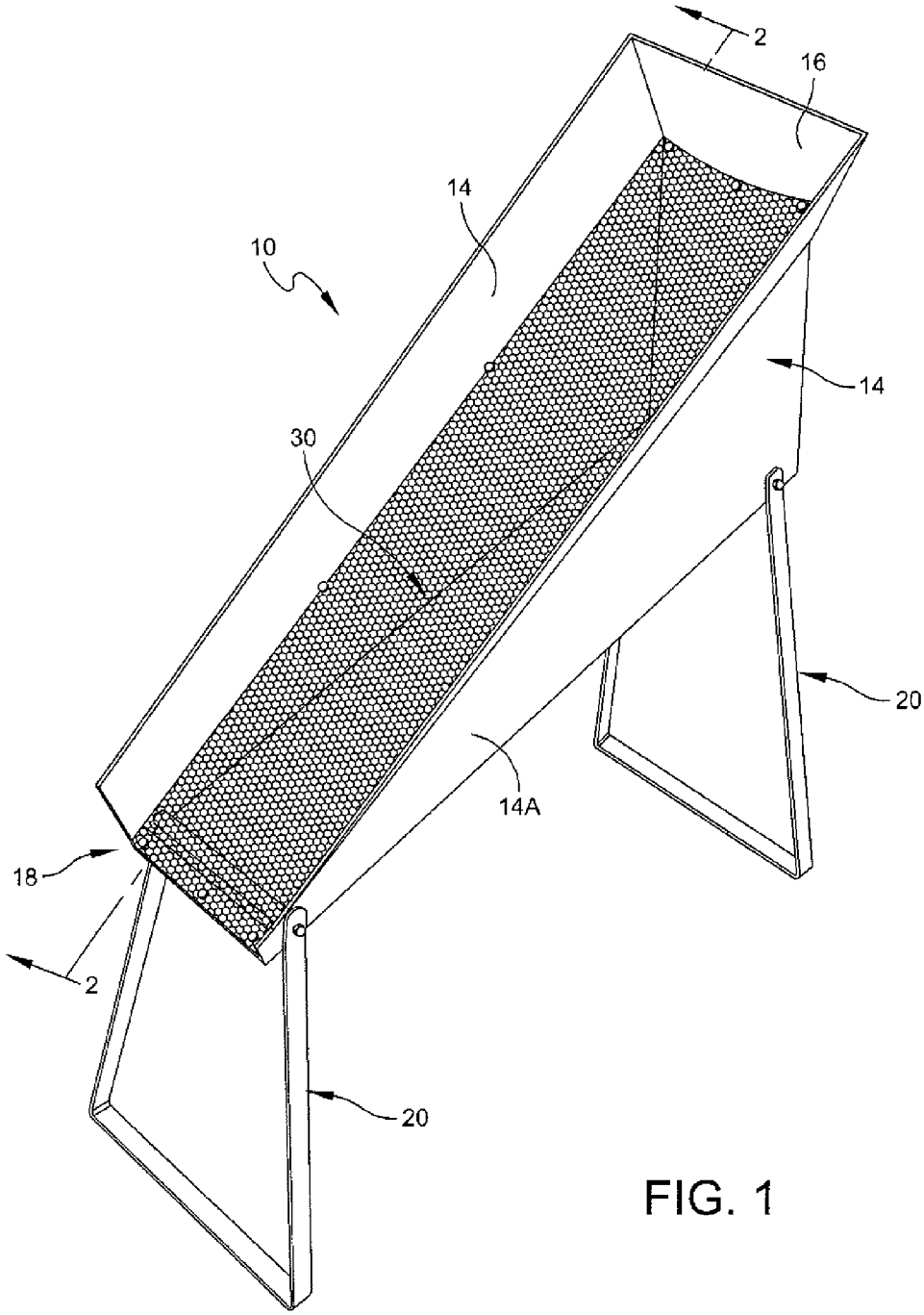
FIG. 1 is a perspective view of a preferred embodiment of the wood pellet screen of the present invention.
Figure 5:
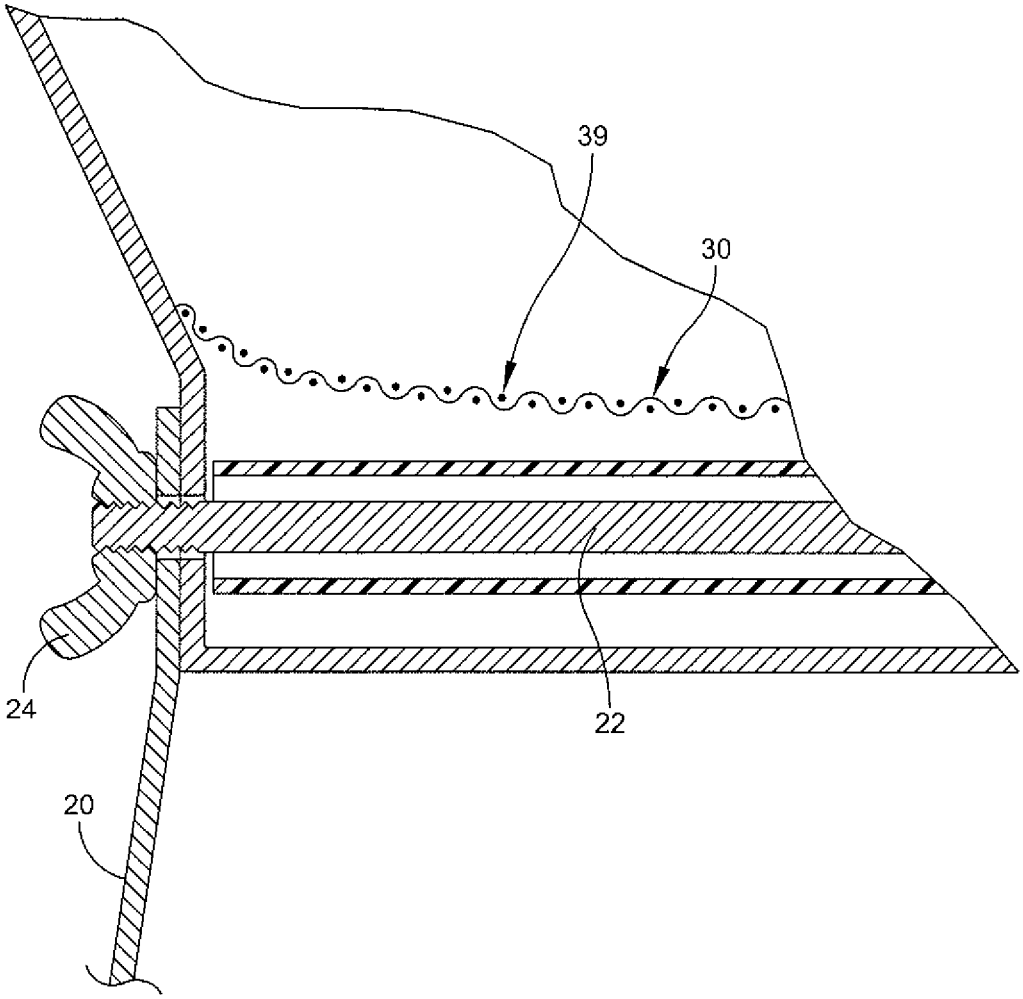
FIG. 5 is a cross-sectional view taken along line 5-5 of FIG. 4.

Thus, it is preferred that the screen 30 has a length substantially greater than its width and also has an arcuate curvature such as shown in FIGS. 1, 4 and 5. See the curvature 39 in FIG. 5. As also indicated previously, the bottom end of the screen is open at 18. This permits the pellets to fall directly into the pail 35 as illustrated in FIGS. 7 and 8.

Refer also to the side cross-sectional view of FIG. 2 taken along line 2-2 of FIG. 1. This illustrates another important aspect of the present invention wherein the screen 30 follows an angle h to the horizontal H. It is important that the angle h fall within a particular range. If the screen 30 is tilted too much, then the pellets 36 progress too quickly along the screen. On the other hand, if the angle h is too small, then the pellets do not progress quickly enough along the screen. The angle h should be between 30 degrees and 45 degrees. In the embodiment illustrated in FIG. 2, the angle h is approximately 35 degrees to the horizontal.

Figure 6:
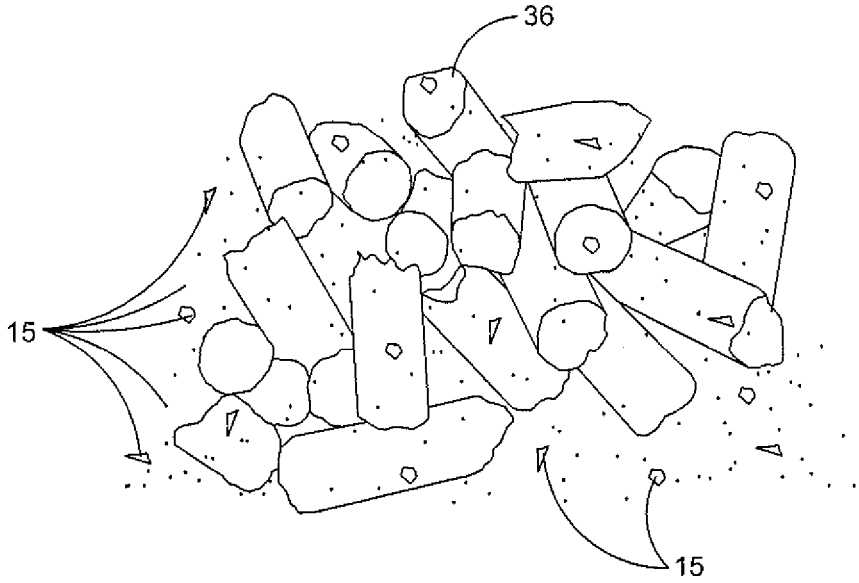
FIG. 6 schematically represents the pellets as they are drawn from the storage bag.
Figure 9:
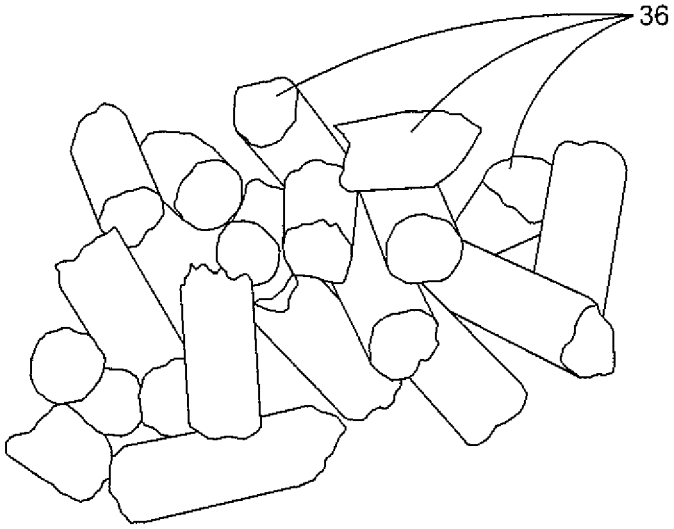
FIG. 9 schematically represents the cleaned pellets.

FIG. 6 schematically illustrates the compilation of pellets as they are taken directly from the bag 37. In FIG. 6 it is noted that, not only are there pellets 36 shown, but also is shown the associated dust or debris at 15 which ends up in the chamber 19. On the other hand, in FIG. 9 the cleaned pellets 36 are schematically depicted.

It is also important that the screen 30 have a slight arcuate curvature as depicted in the drawings. This tends to move the pellets toward the center of the screen, although the bottom end of the screen may have less of an arcuate curvature.

Having now described a limited number of embodiments of the present invention, it should now be apparent to those skilled in the art that numerous other embodiments and modifications thereof are contemplated as falling within the scope of the present invention, as defined by the appended claims.

What is claimed is:

1. A wood pellet screen apparatus comprising:

a housing having a pair of legs for the support thereof;

the housing comprised of a series of interconnected walls that form a collection chamber;

an elongated screen disposed in the housing over the collection chamber;

the screen constructed and arranged to received wood pellets deposited thereon;

the screen further constructed and arranged to be tilted at an angle to the horizontal so that as wood pellets are deposited at a top of the screen the wood pellets progress along the screen under gravity control;

wherein the interconnected walls are comprised of a bottom wall, a pair of side walls, and a rear wall that together define the collection chamber;

wherein the screen has top and bottom ends and opposed sides;

wherein the screen has a length greater than its width, including a center longitudinal axis that extends between the top and bottom ends of the screen and wherein the opposed sides of the screen connect between the respective sidewalls of the housing;

wherein the screen has an arcuate concave curvature in a single curvature with the longitudinal axis disposed at a low point of the curvature;

wherein the screen has a series of adjacent apertures over which the wood pellets progress;

wherein each of the apertures are diamond shaped and each has a set of upwardly facing sharp edges in a V-shape;

wherein each of the upwardly facing edges defining the diamond shaped apertures is sharp so that as each wood pellet progresses down the screen the optimum screening process occurs by virtue of the individual wood pellets contacting these sharp edges to remove any excess particles or dust from the wood pellet;

further including legs for supporting the housing above a ground level including respective front and rear legs respectively supported closer to bottom and rear walls of the housing, the rear leg being longer than the front leg so as to tilt the screen at the angle to the horizontal so that as wood pellets are deposited at a top of the screen the wood pellets progress along the screen under gravity control;

wherein the screen tilt angle is in a range of 30-45 degrees so as to control the rate that the particles progress as they travel down the screen under gravity control.

2. The wood pellet screen apparatus of claim 1 including a clean out port in the rear wall through which collected dust and debris may be removed from the chamber.

3. The wood pellet screen apparatus of claim 1 wherein the screen tilt angle is on the order of 35 degrees.

4. The wood pellet screen apparatus of claim 1 including two pairs of legs spaced apart on the housing and each formed from a single U-shaped leg piece, the legs being supported for pivoting between a use position and a storage position, the legs being supported by a support rod and securing nuts for loosening or tightening the positions.

* * * * *